US006513230B2

(12) United States Patent
Inoue et al.

(10) Patent No.: US 6,513,230 B2
(45) Date of Patent: Feb. 4, 2003

(54) COIL APPARATUS AND MANUFACTURING METHOD FOR THE SAME

(75) Inventors: Keiji Inoue, Yokohama (JP); Jun Nagai, Sagamihara (JP); Tadahiro Matsumoto, Yokohama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/885,883

(22) Filed: Jun. 20, 2001

(65) Prior Publication Data

US 2002/0109572 A1 Aug. 15, 2002

(30) Foreign Application Priority Data

Jun. 20, 2000 (JP) ..... 2000-185062
Dec. 12, 2000 (JP) ..... 2000-377680

(51) Int. Cl.[7] ..... H01F 7/06

(52) U.S. Cl. ..... 29/606; 29/832; 29/602.1; 336/196; 361/760; 361/761

(58) Field of Search ..... 29/606, 832, 602.1, 29/604; 361/736, 740, 741, 742, 748, 760, 761; 336/100, 196, 197, 226

(56) References Cited

U.S. PATENT DOCUMENTS 3,348,276 A 10/1967 Miknaitis
5,025,211 A * 6/1991 Craft et al. ..... 324/158 R
5,117,330 A * 5/1992 Miazga ..... 361/400
6,028,500 A 2/2000 Buist
6,326,875 B1 * 12/2001 Tuovinen ..... 336/197

FOREIGN PATENT DOCUMENTS

DE 4029704 3/1992
GB 2129622 5/1984

* cited by examiner

*Primary Examiner*—David J. Walczak
(74) *Attorney, Agent, or Firm*—Keating & Bennett, LLP

(57) ABSTRACT

A core-coupling unit includes a top cover and a bottom cover each having a U-shape. The core-coupling unit clamps a pair of core members in a coupled state with the top cover and the bottom cover being coupled with each other. The top cover is provided with apertures formed in respective legs of the top cover, and the bottom cover is provided with projections formed on respective legs of the bottom cover, the projections mating with the apertures so as to prevent removal. Play-gaps are provided between each projection and respective front and rear edges of the aperture. Lips are provided on the covers for maintaining the positions of the core members in the backward and forward directions. The top and bottom covers are moved backward and forward relative to each other while the core members are clamped, whereby the core members are moved together with the respective top and bottom covers, thereby performing core-rubbing.

16 Claims, 7 Drawing Sheets

COIL APPARATUS AND MANUFACTURING METHOD FOR THE SAME

CROSS REFERENCE TO RELATED APPLICATION

This is related to Ser. No. 09/885,084 filed on even date herewith titled COIL APPARATUS AND MANUFACTURING METHOD FOR THE SAME, the disclosures of which are incorporated by reference herein.

BACKGROUND OF THE INVENTION

1. Field of the Invention

The present invention relates to coil apparatuses capable of serving as transformers and choke coils and a method for manufacturing the same.

2. Description of the Related Art

FIG. 7A is an exploded view of a coil apparatus. FIG. 7B is a sectional view taken along line 7B—7B of the coil apparatus shown in FIG. 7A. A coil apparatus 1 shown in FIGS. 7A and 7B is incorporated in a circuit such as a DC-to-DC converter, and serves as a transformer or a choke coil. The coil apparatus 1 includes an electronic-part-mounting substrate 2, a coil pattern group 3 formed on the electronic-part-mounting substrate 2, a pair of core members 4(4*a*) and 4(4*b*), and a core-coupling unit 5'.

The electronic-part-mounting substrate 2 carries electronic parts for forming a circuit, and a circuit pattern is formed on the electronic-part-mounting substrate 2. The electronic-part-mounting substrate 2 is a multi-layered substrate including a plurality of substrate elements laminated on each other. For example, the plurality of substrate elements may be individually provided with coil patterns 7 which are disposed coaxially with each other, the coil patterns 7 forming the coil pattern group 3. When the coil apparatus 1 is used as a transformer apparatus, at least one of the coil patterns 7 serves as a primary coil and the remainder serves as a secondary coil.

The pair of core members 4(4*a*) and 4(4*b*) shown in FIGS. 7A and 7B are made of a powdered magnetic material such as a ferrite by sintering. The core members 4(4*a*) and 4(4*b*) are E-type core members which individually include planar top plates 8, each top plate 8 being provided with core-legs 9(9*a*), 9(9*b*), and 9(9*c*) projecting from one end, an intermediate part, and the other end, respectively, of the top plate 8, whereby the cross-section of each core member 4(4*a*) or 4(4*b*) is E-shaped.

The electronic-part-mounting substrate 2 is provided with core-leg-passing through-holes 10(10*a*), 10(10*b*), and 10(10*c*) in an outside part, a central part, and the opposite outside part, respectively, of the coil pattern group 3. As shown in FIG. 7B, the core-legs 9(9*a*), 9(9*b*), and 9(9*c*) of each core member 4(4*a*) or 4(4*b*) are inserted into the core-leg-passing through-holes 10(10*a*), 10(10*b*), and 10(10*c*), respectively, from the top or bottom side of the electronic-part-mounting substrate 2. The core-legs 9*a*, 9*b*, and 9*c* of the top core member 4(4*a*) come into contact with the respective core-legs 9(9*a*), 9(9*b*), and 9(9*c*) of the bottom core member 4(4*b*) at tips of the core-legs 9(9*a*), 9(9*b*), and 9(9*c*) of the respective core members 4(4*a*) and 4(4*b*).

The core-coupling unit 5' receives and couples the pair of core members 4(4*a*) and 4(4*b*) with each other, as shown in FIG. 7B. The core-coupling unit 5' is formed by bending a metallic plate, and includes a top plate 12, legs 13(13*a*) and 13(13*b*), and hooks 14(14*a*) and 14(14*b*). That is, the top plate 12 for covering the top plate 8 of the core member 4(4*a*) is bent in the standing direction of the core-legs 9(9*a*), 9(9*b*), and 9(9*c*) at the right and left ends of the top plate 12, thereby forming the legs 13(13*a*) and 13(13*b*), and the legs 13(13*a*) and 13(13*b*) are individually bent toward the inside at the ends thereof, thereby forming the hooks 14(14*a*) and 14(14*b*).

The distance between the top plate 12 and the hooks 14 is substantially the same as a distance h between an outer surface 8*a* of the top plate 8 of the top core member 4(4*a*) and the outer surface 8*a* of the top plate 8 of the bottom core member 4(4*b*) when the core-legs 9(9*a*), 9(9*b*), and 9(9*c*) of the top core member 4(4*a*) are in contact with the respective core-legs 9(9*a*), 9(9*b*), and 9(9*c*) of the bottom core member 4(4*b*) at tips of the core-legs 9(9*a*), 9(9*b*), and 9(9*c*) of the core members 4(4*a*) and 4(4*b*), as shown in FIG. 7B. As shown in FIG. 7B, the core-coupling unit 5' couples the core members 4(4*a*) and 4(4*b*) with each other, the core-legs 9(9*a*), 9(9*b*), and 9(9*c*) of the respective core members 4(4*a*) and 4(4*b*) being in contact with each other at the tips of the core-legs 9(9*a*), 9(9*b*), and 9(9*c*), so that the core members 4(4*a*) and 4(4*b*) are clamped at the left and right ends thereof by the top plate 12 and the hooks 14(14*a*) and 14(14*b*), respectively. The core members 4(4*a*) and 4(4*b*) are coupled with each other so as to be movable relative to each other in directions (backward and forward) shown in FIG. 7A. A width W in the backward and forward directions of each core-leg-passing through-hole 10(10*a*), 10(10*b*), or 10(10*c*) is set greater than a width w of each core-leg 9(9*a*), 9(9*b*), or 9(9*c*) of the core member 4(4*a*) or 4(4*b*) so that the core members 4(4*a*) and 4(4*b*) can move backward and forward.

The coil apparatus shown in FIGS. 7A and 7B is formed, for example, as described below. The core members 4(4*a*) and 4(4*b*) are disposed at the top and bottom sides, respectively, of the electronic-part-mounting substrate 2 provided with the coil pattern group 3 and the core-leg-passing through-holes 10(10*a*), 10(10*b*), and 10(10*c*). The core-legs 9(9*a*), 9(9*b*), and 9(9*c*) of the top core member 4(4*a*) are inserted into the corresponding core-leg-passing through-holes 10(10*a*), 10(10*b*), and 10(10*c*), respectively, of the electronic-part-mounting substrate 2 from the topside thereof, and the core-legs 9(9*a*), 9(9*b*), and 9(9*c*) of the bottom core member 4(4*b*) are inserted into the corresponding core-leg-passing through-holes 10(10*a*), 10(10*b*), and 10(10*c*), respectively, of the electronic-part-mounting substrate 2 from the bottom side thereof, so that the core-legs 9(9*a*), 9(9*b*), and 9(9*c*) of the respective top and bottom core members 4(4*a*) and 4(4*b*) come into contact with each other at the tips thereof.

The legs 13(13*a*) and 13(13*b*) of the core-coupling unit 5' are inserted, from the top of the core members 4(4*a*) and 4(4*b*) coupled with each other so that the respective core-legs 9(9*a*), 9(9*b*), and 9(9*c*) are in contact with each other at the tips thereof, into the left core-leg-passing through-hole 10(10*a*) at the outer side of the core-leg 9(9*a*) and the right core-leg-passing through-hole 10(10*c*) at the other outer side of the core-leg 9(9*c*), respectively.

The core-coupling unit 5' thus coupling the core members 4(4*a*) and 4(4*b*) with each other is incorporated into the electronic-part-mounting substrate 2. That is, the core members 4(4*a*) and 4(4*b*), by being thus incorporated into the electronic-part-mounting substrate 2, are mounted on the coil pattern group 3 in such a manner that the core members 4(4*a*) and 4(4*b*) clamp the electronic-part-mounting substrate 2 at a part of the coil pattern group 3 from the top and bottom sides of the electronic-part-mounting substrate 2.

Then, the coupled core members 4(4*a*) and 4(4*b*) are slid backward and forward relative to each other, so as to rub against each other at a contact part between the core members 4(4*a*) and 4(4*b*), that is, at the tips of the core-legs 9(9*a*), 9(9*b*), and 9(9*c*) of the respective core members 4(4*a*) and 4(4*b*). By thus rubbing the tips of the core-legs 9(9*a*), 9(9*b*), and 9(9*c*) with each other (by performing core-rubbing), an effect described below can be obtained.

As described above, since the core members 4(4*a*) and 4(4*b*) are made by sintering a powdered magnetic material, the tips of the core-legs 9(9*a*), 9(9*b*), and 9(9*c*) of the core members 4(4*a*) and 4(4*b*) are initially coarse. Moreover, when coupling the core members 4(4*a*) and 4(4*b*) with each other, dust is received between the core-legs 9(9*a*), 9(9*b*), and 9(9*c*) of the core members 4(4*a*) and the core-legs 9(9*a*), 9(9*b*), and 9(9*c*) of the core members 4(4*b*). Therefore, the tips of the core-legs 9(9*a*), 9(9*b*), and 9(9*c*), when coupled, are not in close contact with each other. By performing core-rubbing, the tips of the core-legs 9(9*a*), 9(9*b*), and 9(9*c*) become substantially mirror-finished, and the dust received between the core-legs 9(9*a*), 9(9*b*), and 9(9*c*) is removed, whereby the tips of the core-legs 9(9*a*), 9(9*b*), and 9(9*c*) of the top core member 4(4*a*) and the tips of the core-legs 9(9*a*), 9(9*b*), and 9(9*c*) of the bottom core member 4(4*b*) are brought into close contact with each other. By thus bringing the core members 4(4*a*) and 4(4*b*) into close contact with each other, the inductance value can be prevented from decreasing and deterioration of the characteristics of the coil apparatus 1 can be avoided.

In the above known coil apparatus, the pair of core members 4(4*a*) and 4(4*b*) are firmly pressed and clamped by the core-coupling unit 5' at the left and right ends of the top and bottom faces of the pair of core members 4(4*a*) and 4(4*b*). This causes a problem, in that the core members 4(4*a*) and 4(4*b*) do not move to slide on each other unless a large force is applied to the core members 4(4*a*) and 4(4*b*) when performing core-rubbing.

However, applying a large force when rubbing the core members 4(4*a*) and 4(4*b*) against each other causes a further problem. In order to reduce the thickness of the coil apparatus, in order to comply with recent requirements, it is desirable to reduce the thickness of the core members 4(4*a*) and 4(4*b*). When this is done, the core members 4(4*a*) and 4(4*b*) may be broken or cracked by the large applied force. Therefore, it has been difficult to reduce the thickness of the core members 4(4*a*) and 4(4*b*), which has made the reduction in thickness of the coil apparatus 1 more difficult.

SUMMARY OF THE INVENTION

In response to these problems, the present invention provides a coil apparatus and a method for manufacturing the same, in which core members can be reduced in thickness and easily rubbed against each other in the assembly process of the coil apparatus, and breakage of the core members is suppressed, whereby the coil apparatus can be reduced in thickness.

To these ends, according to an aspect of the present invention, a coil apparatus comprises a coil pattern group formed on an electronic-part-mounting substrate for mounting electronic parts; a pair of core members mounted on the coil pattern group in a manner such that the pair of core members clamp a part of the coil pattern group from the top and bottom sides of the electronic-part-mounting substrate; core-leg-passing through-holes formed in a region of the electronic-part-mounting substrate in which the coil pattern group is provided, the core-leg-passing through-holes being provided for receiving core-legs passing therethrough, the core-legs being provided on at least one of the pair of core members; and a core-coupling unit which clamps and couples the pair of core members with each other from the top and bottom sides of the electronic-part-mounting substrate by using the core-leg-passing through-holes. The core-coupling unit includes a top cover and a bottom cover each having a U-shape, the top cover and the bottom cover clamping the core members at the top and bottom sides of the core members between base plates of the respective U-shaped top cover and bottom cover with legs of the respective U-shaped top cover and bottom cover being coupled with each other. Portions of the top cover and the bottom cover define an anti-removal unit which maintains the legs of the respective top cover and bottom cover in a coupled state; a backward-forward-core-position-restricting unit which restricts the positions of the core members with respect to the respective top cover and bottom cover in the backward and forward directions; and a backward-forward-movement-allowing unit which allows backward and forward movement of the top cover and the bottom cover relative to each other when the core members are clamped between the top cover and the bottom cover, the legs of which are maintained in a coupled state by the anti-removal unit, and which moves the top core member and the top cover as a unit or the bottom core member and the bottom cover as another unit backward and forward relative to each other, the positions of the top core member and the bottom core member being individually restricted in the backward and forward directions with respect to the top cover and the bottom cover, respectively, by the backward-forward-core-position-restricting unit.

The anti-removal unit may be formed with apertures formed in first legs of one of the top cover and the bottom cover, the first legs being disposed outside second legs of the other one of the top cover and the bottom cover, and projections formed on the second legs of the other one of the top cover and the bottom cover, for anchoring at the corresponding apertures so as to prevent removal, the second legs being disposed inside the first legs of the one of the top cover and the bottom cover. The backward-forward-movement-allowing unit may be formed with play-gaps between each projection and respective front and rear edges of the aperture of the anti-removal unit.

The legs of at least one of the top cover and the bottom cover may be each provided with cut-away parts for providing relief at regions of the leg which come into contact with edges of the core-leg-passing through-hole when the one of the top cover and the bottom cover moves backward and forward. The projections of the anti-removal unit may each include inclined faces along which the edges of each aperture climb when the top cover and the bottom cover move backward and forward relative to each other.

The backward-forward-core-position-restricting unit may include lips which protrude in the thickness direction from front ends and rear ends, respectively, of the base plates and which anchor at front end-faces and rear end-faces, respectively, of the core members.

The coil apparatus according to the present invention may further comprise a fixing unit for fixing the core members either directly or indirectly via the core-coupling unit to the electronic-part-mounting substrate.

The fixing unit may comprise a bonding material made of a resin.

According to another aspect of the present invention, a method is provided for manufacturing a coil apparatus which comprises a coil pattern group formed on an electronic-part-mounting substrate for mounting electronic parts; a pair of core members mounted on the coil pattern group in a manner such that the pair of core members clamp a part of the coil pattern group from the top and bottom sides of the electronic-part-mounting substrate; core-leg-passing through-holes formed in a region of the electronic-part-mounting substrate in which the coil pattern group is provided, the core-leg-passing through-holes being provided for receiving core-legs passing therethrough, the core-legs being provided on at least one of the pair of core members; and a core-coupling unit which clamps and couples the pair of core members with each other from the top and bottom sides of the electronic-part-mounting substrate by using the core-leg-passing through-holes, wherein the core-coupling unit includes a top cover and a bottom cover each having a U-shape, the top cover and the bottom cover clamping the core members at the top and bottom sides of the core members between base plates of the respective U-shaped top cover and bottom cover with legs of the respective U-shaped top cover and bottom cover being coupled with each other, the core-coupling unit including an anti-removal unit which maintains the legs of the respective top cover and bottom cover in a coupled state; a backward-forward-core-position-restricting unit which restricts the positions of the core members with respect to the respective top cover and bottom cover in the backward and forward directions; and a backward-forward-movement-allowing unit which allows backward and forward movement of the top cover and the bottom cover relative to each other when the core members are clamped between the top cover and the bottom cover of which the legs are maintained in a coupled state by the anti-removal unit, and which moves the top core member and the top cover as a unit or the bottom core member and the bottom cover as another unit backward and forward relative to each other, the positions of the top core member and the bottom core member being individually restricted in the backward and forward directions with respect to the top cover and the bottom cover, respectively, by the backward-forward-core-position-restricting unit. The method comprises the steps of disposing the pair of core members at the top and bottom sides, respectively, of the electronic-part-mounting substrate; disposing the top cover of the core-coupling unit outside the top core member and the bottom cover of the core-coupling unit outside the bottom core member; mounting the pair of core members onto the coil pattern group, the pair of core members being coupled with each other by being clamped by the top cover and the bottom cover which are coupled with each other; and rubbing the top core member and the bottom core member against each other at the contact part therebetween by slidingly moving the top core member and the top cover as a unit or the bottom core member and the bottom cover as another unit relative to each other, thereby bringing the top core member and the bottom core member into close contact against each other.

The method for manufacturing a coil apparatus may further comprise the step of fixing the core members either directly or indirectly via the core-coupling unit to the electronic-part-mounting substrate by using a fixing unit after the step of rubbing the top core member and the bottom core member against each other.

According to the present invention, the core-coupling unit includes the top cover and the bottom cover. A pair of the core members can be coupled with each other by being clamped by the top cover and the bottom cover coupling with each other. Therefore, the clamping force of the core-coupling unit to be applied to the core members is small compared with the known coil apparatus.

Since the core-coupling unit including the top cover and the bottom cover is provided with the backward-forward-core-position-restricting unit and the backward-forward-movement-allowing unit, the top cover and the bottom cover can be moved backward and forward relative to each other when the core members are clamped by using the anti-removal unit, and the top core member and the bottom core member can be moved backward and forward relative to each other and together with the top cover and the bottom cover, respectively, whereby core-rubbing can be performed by applying only a small force. Therefore, the core-rubbing can be performed efficiently.

As described above, the pair of core members can be moved backward and forward relative to each other by applying a small force, thereby performing core-rubbing. Therefore, a risk of breakage of the core members during core-rubbing can be suppressed even when the core members are made thin, whereby the core members can be made thin and reduction in thickness of the coil apparatus can be advanced.

When the anti-removal unit is formed with the apertures and the projections, and the play-gaps between each projection and the front and rear edges of the aperture, are formed as a backward-forward-movement-allowing unit, the top cover and the bottom cover can be moved backward and forward relative to each other when the legs of the top cover and the bottom cover couple with each other in a very simple configuration.

When cut-away parts are formed in the legs of at least one of the top cover and the bottom cover, and inclined faces are formed on the projections of the anti-removal unit, on which inclined faces the edges of the apertures climb when the top cover and the bottom cover move backward and forward relative to each other, the amount of movement of the top cover and the bottom cover relative to each other can be maintained by the cut-away parts and the inclined faces of the projections even when the play-gaps between the edges of each aperture and the projection are reduced so as to facilitate positioning of the top cover and the bottom cover.

With the above-described arrangement, the pair of core members can be coupled with each other without variations in position, core-rubbing can be efficiently performed, and the pair of core members can be reliably brought into close contact with each other, whereby deterioration of the characteristics of the coil apparatus can be avoided, and a highly reliable coil apparatus can be provided.

When the position-restricting unit which restricts the positions of the core members in the backward and forward directions is formed by the lips provided at the front ends and the rear ends, respectively, of base plates of the top cover and the bottom cover, respectively, the positions of the core members can be restricted by a simple structure.

When a fixing unit which fixes the core members to the electronic-part-mounting substrate is provided, the displacement of the core members during, for example, transportation of the electronic-part-mounting substrate after the process of core-rubbing can be reliably avoided by fixing the core members to the electronic-part-mounting substrate by using the fixing unit, whereby reliability of the characteristics of the coil apparatus can be further improved.

When the fixing unit is formed with a bonding material having a resin, the core members can be easily fixed to the electronic-part-mounting substrate by using the bonding material which can be obtained at a low cost, thereby preventing the cost of the coil apparatus from increasing.

Other features and advantages of the present invention will become apparent from the following description of the invention which refers to the accompanying drawings.

DETAILED DESCRIPTION OF EMBODIMENTS OF THE INVENTION

Figure 1:
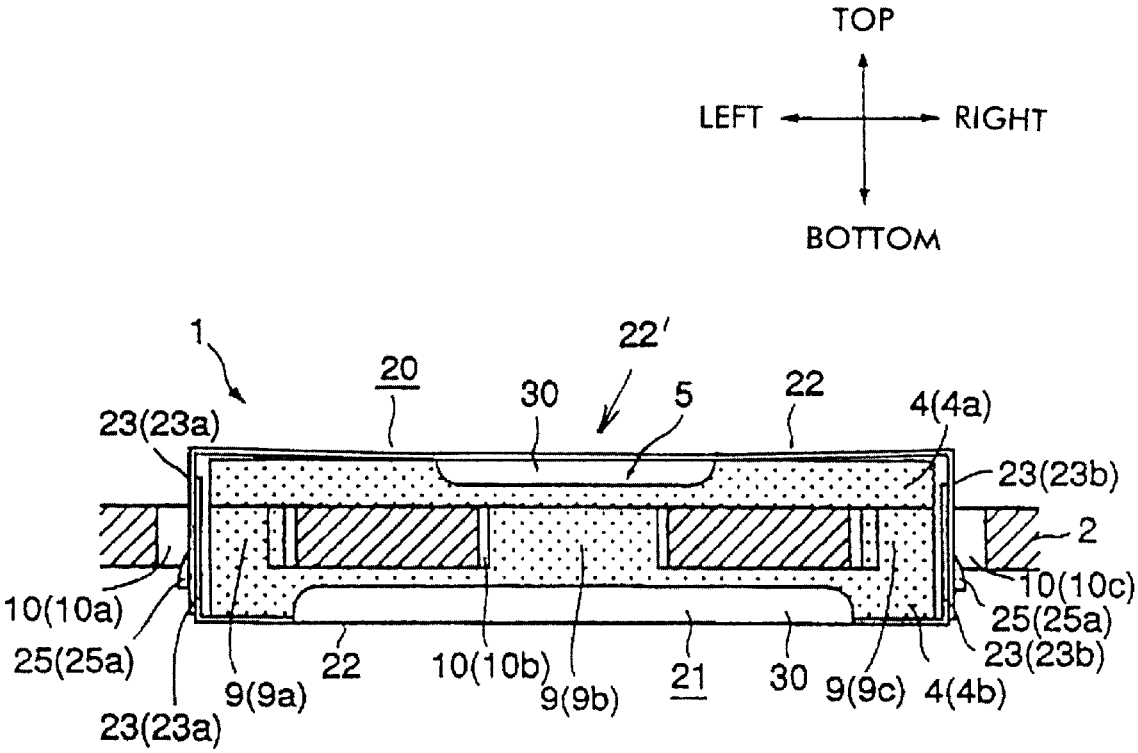
FIG. 1 is an illustration of a coil apparatus according to a first embodiment of the present invention.

Embodiments according to the present invention are described below with reference to the drawings. The same components as those of the known coil apparatus which are described above are referred to with the same reference numerals, and the description concerning those components is omitted.

Figure 2A:
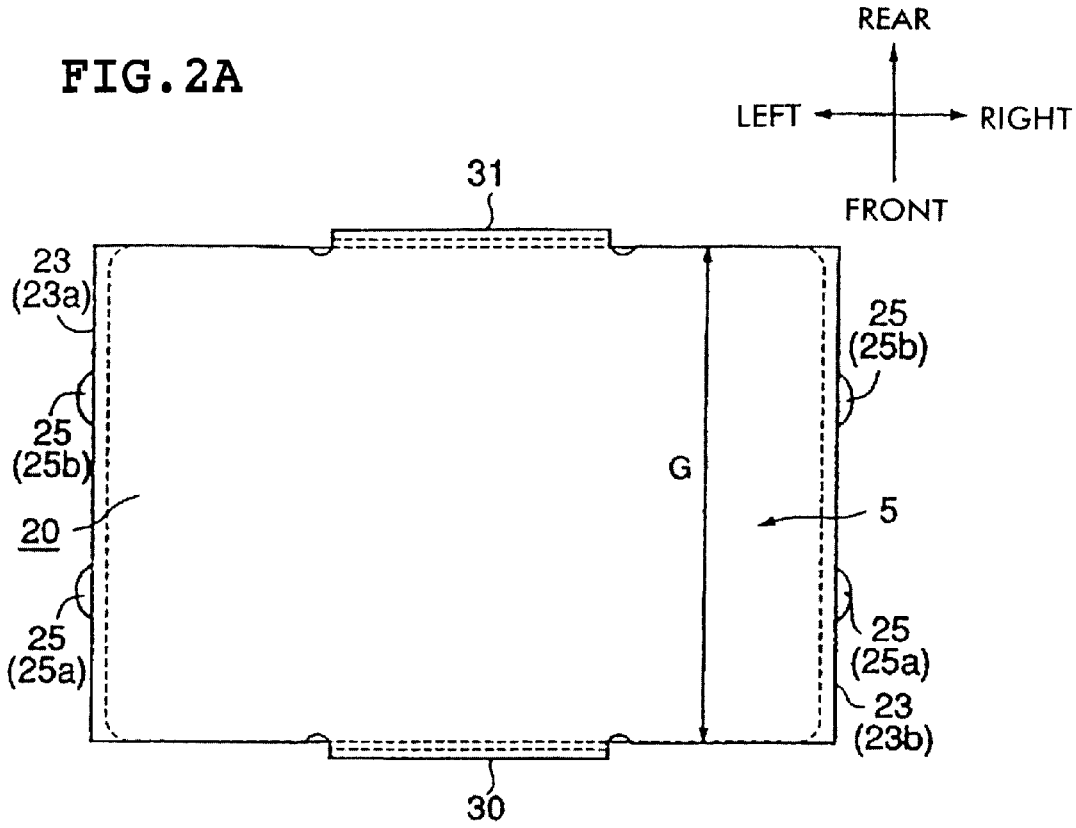
FIGS. 2A and 2B are illustrations of a typical core-coupling unit of the coil apparatus shown in FIG. 1.
Figure 2B:
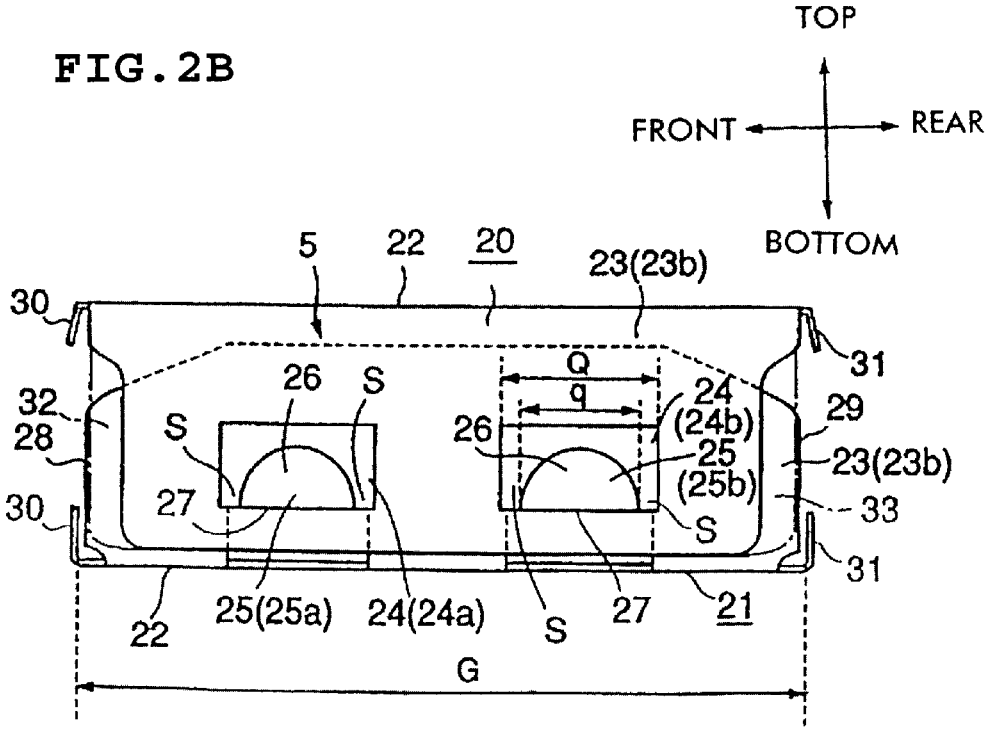
Figure 5A:
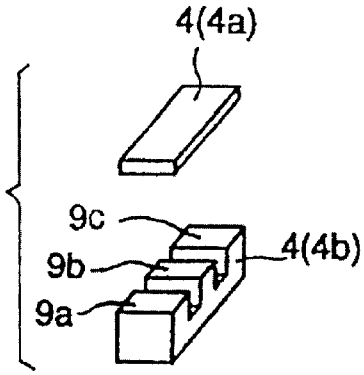
FIGS. 5A, 5B, 5C, and 5D are illustrations showing other embodiments of the present invention.
Figure 5B:
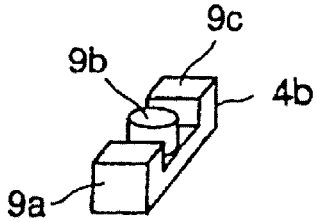

FIG. 1 is a schematic illustration in front view of a coil apparatus according to a first embodiment of the present invention. A coil apparatus 1 according to the first embodiment includes a core-coupling unit 5 having a typical configuration. FIG. 2A shows the core-coupling unit 5, according to the first embodiment, viewed from the top. FIG. 2B is an illustration of the core-coupling unit 5 shown in FIG. 2A viewed from the right. The configuration of the coil apparatus 1 other than that of the core-coupling unit 5 is substantially the same as that of the known coil apparatus. FIG. 5A shows a pair of core members 4(4*a*) and 4(4*b*) and FIG. 5B shows a core member 4*b*. The core member 4(4*a*) is an I-type core member having an I-shaped cross-section, and the core member 4(4*b*) in FIG. 5A is an E-type core member having an E-shaped cross-section. The core member 4*b* shown in FIG. 5B is an EER-type core member.

In FIGS. 1, 2A, and 2B, the core-coupling unit 5, according to the first embodiment, includes a top cover 20 and a bottom cover 21. The top and bottom covers 20 and 21 are made by bending metallic plates. Each cover 20 or 21 includes a planar base plate 22 and legs 23(23*a*) and 23(23*b*) projecting respectively from the left and right ends of the base plate 22, and is formed in a U-shape, as shown in FIG. 1.

The top cover 20 and the bottom cover 21 clamp the pair of core members 4(4*a*) and 4(4*b*) between the base plates 22 of the respective covers 20 and 21 from the top and bottom sides, respectively, of an electronic-part-mounting substrate 2, so that the legs 23(23*a*) and 23(23*b*) of the respective covers 20 and 21 couple with each other.

As shown in FIGS. 1, 2A, and 2B, a front lip 30 protrudes in a thickness direction of the electronic-part-mounting substrate 2 at a front edge of each base plate 22 of the top cover 20 or the bottom cover 21. A rear lip 31 protrudes in the thickness direction of the electronic-part-mounting substrate 2 at a rear edge of each base plate 22 of the top cover 20 or the bottom cover 21.

A width G in the backward and forward directions of each base plate 22 of the top cover 20 or the bottom cover 21 shown in FIGS. 2A and 2B is set substantially the same as a width w in the backward and forward directions of the core members 4(4*a*) and 4(4*b*). When the pair of core members 4(4*a*) and 4(4*b*) are clamped between the base plates 22 so that the legs 23(23*a*) and 23(23*b*) of the respective top cover 20 and bottom cover 21 couple with each other, the front lips 30 of the top cover 20 and the bottom cover 21 come into contact with the front side faces of the core member 4(4*a*) and the core member 4(4*b*), respectively. The rear lips 31 of the top cover 20 and the bottom cover 21 come into contact with the rear side faces of the core member 4(4*a*) and the core member 4(4*b*), respectively.

The position of each core member 4(4*a*) or 4(4*b*) is restricted in the backward and forward directions with respect to the top cover 20 or the bottom cover 21, respectively, by the front lips 30 and the rear lips 31 which anchor at the front side faces and the rear side faces, respectively, of the core members 4(4*a*) and 4(4*b*). Thus, a position-restricting unit for restricting the position of the core members 4(4*a*) and 4(4*b*) in the backward and forward directions is formed by the front lips 30 and the rear lips 31.

The legs 23(23*a*) and 23(23*b*) of the top cover 20 which are disposed outside the legs 23(23*a*) and 23(23*b*), respectively, of the bottom cover 21, as shown in FIGS. 1 and 2B, are provided with apertures 24(24*a*) and 24(24*b*), respectively, as shown in FIG. 2B. The legs 23(23*a*) and 23(23*b*) of the bottom cover 21 which are disposed inside the legs 23(23*a*) and 23(23*b*), respectively, of the top cover 20 are provided with projections 25(25*a*) and 25(25*b*), respectively, which project toward the outside through the apertures 24(24*a*) and 24(24*b*), respectively, of the top cover 20. Each projection 25(25*a*) or 25(25*b*) has a spherical curved face (inclined face) 26 and a planar anchoring face 27 which anchors at the edge of the aperture 24(24*a*) or 24(24*b*), respectively. The positions of the apertures 24(24*a*) and 24(24*b*) and the projections 25(25*a*) and 25(25*b*) are set so that the core members 4(4*a*) and 4(4*b*), which are coupled with each other and clamped between the top cover 20 and the bottom cover 21, are prevented from removal by the anchoring faces 27 of the projections 25(25*a*) and 25(25*b*) anchoring at the edges of the apertures 24(24*a*) and 24(24*b*), respectively, when the legs 23(23*a*) and 23(23*b*) couple with each other.

As described above, the apertures 24(24*a*) and 24(24*b*) and the projections 25(25*a*) and 25(25*b*) form an anti-removal unit for maintaining a coupled state of the legs 23(23*a*) and 23(23*b*), according to the first embodiment.

According to the first embodiment, as shown in FIG. 2B, a width Q in the backward and forward directions of each aperture 24*a* or 24*b* is set greater than a width q in the backward and forward directions of the projection 25(25*a*) or 25(25*b*). Play-gaps S are formed between each projection 25(25*a*) or 25(25*b*) and the front and rear edges of the aperture 24(24*a*) or 24(24*b*), respectively. By virtue of the play-gaps S, the top cover 20 and the bottom cover 21 clamping the core members 4(4*a*) and 4(4*b*) can move a limited distance backward and forward relative to each other. Thus, a backward-forward-movement-allowance unit is formed by the play-gaps S, according to the first embodiment, for allowing backward and forward movement of the top cover 20 and the bottom cover 21 relative to each other.

By the front lips 30 and the rear lips 31, according to the first embodiment, as described above, the position of the core member 4(4*a*) disposed at the top side is restricted in the backward and forward directions with respect to the top cover 20, and the position of the core member 4(4*b*) disposed at the bottom side is restricted in the backward and forward directions with respect to the bottom cover 21. Since the top cover 20 and the bottom cover 21 are capable of moving backward and forward relative to each other, the core members 4(4*a*) and 4(4*b*) can also be moved backward and forward relative to each other, together with the top cover 20 and the bottom cover 21, respectively. Thus, core-rubbing can be performed by moving the top cover 20 and the bottom cover 21 backward and forward relative to each other while the top cover 20 and the bottom cover 21 are clamping the core members 4(4*a*) and 4(4*b*).

When performing core-rubbing, preferably, one of the top and bottom covers 20 and 21, for example, the bottom cover 21 is substantially fixed, and the top cover 20 is moved backward and forward, thereby rubbing the core members 4(4*a*) and 4(4*b*), instead of individually moving both the top cover 20 and the bottom cover 21 backward and forward.

Figure 7A:
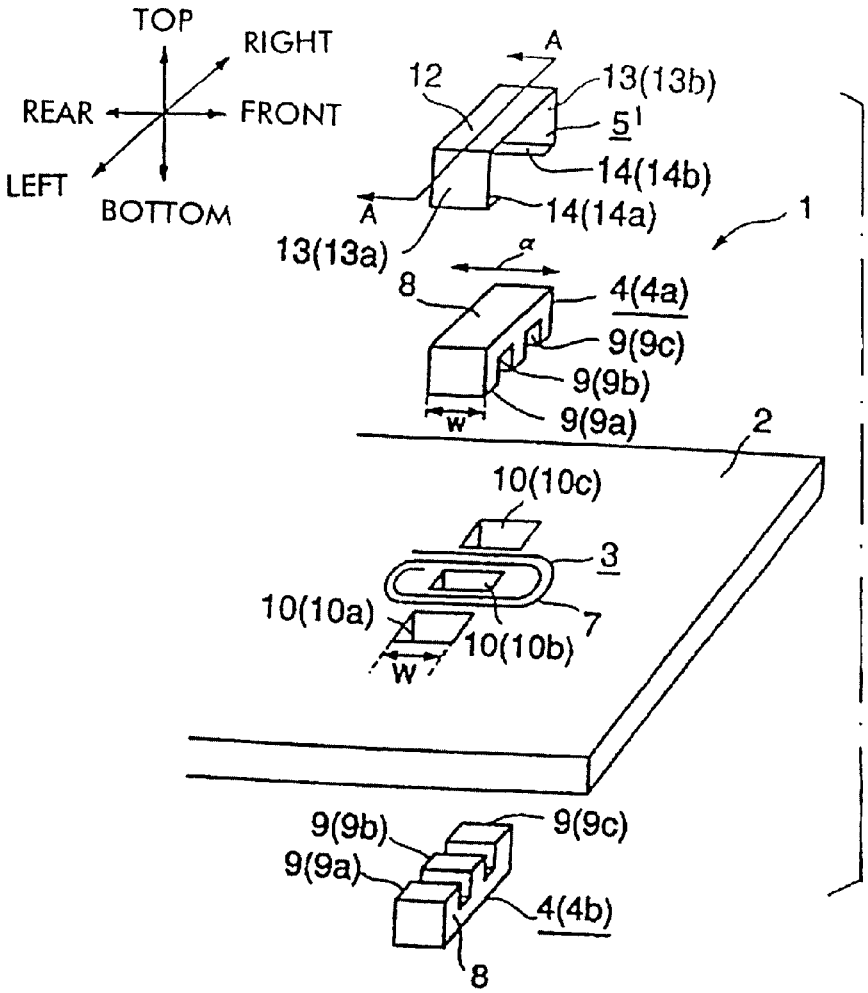
FIG.7A PRIOR ART
FIGS. 7A and 7B are illustrations of a known coil apparatus.
Figure 7B:
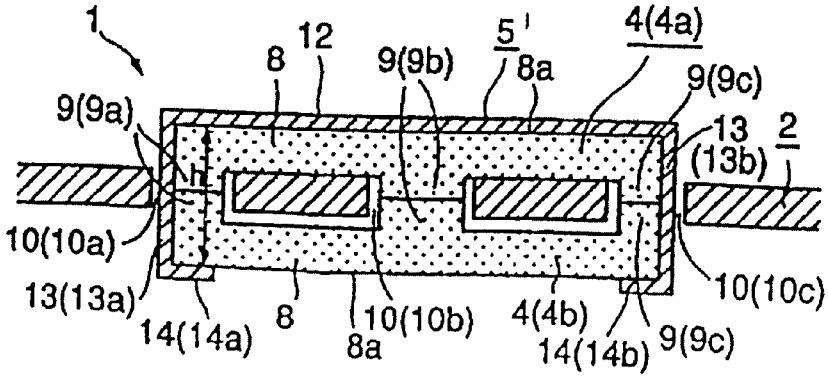
FIG.7B PRIOR ART

Since the bottom cover 21 in this example is substantially fixed, the width W in the backward and forward directions of the core-leg-passing through-hole 10(10*a*), 10(10*b*), or 10(10*c*) shown in FIG. 7A is set substantially the same as the width G in the backward and forward directions of the leg 23(23*a*) or 23(23*b*) of the bottom cover 21 shown in FIG. 2B. Therefore, when the legs 23(23*a*) and 23(23*b*) of the bottom cover 21 are inserted into the core-leg-passing through-holes 10(10*a*) and 10(10*c*), respectively, as shown in FIG. 1, play-gaps between the edges of each core-leg-passing through-hole 10(10*a*) or 10(10*c*) and front and rear end-faces 28 and 29, respectively, of the leg 23(23*a*) or 23(23*b*) of the bottom cover 21 shown in FIG. 2B become very small, whereby the bottom cover 21 is substantially fixed in the backward and forward directions.

Each of the legs 23(23*a*) and 23(23*b*) of the top cover 20 is provided with cut-away parts 32 and 33 for providing relief formed at portions of the leg 23(23*a*) or 23(23*b*) which come into contact with the edges of the core-leg-passing through-holes 10(10*a*) and 10(10*c*), respectively. By providing the cut-away parts 32 and 33, the top cover 20 can move backward and forward when the legs 23(23*a*) and 23(23*b*) thereof are inserted into the core-leg-passing through-holes 10(10*a*) and 10(10*c*), respectively.

Figure 3A:
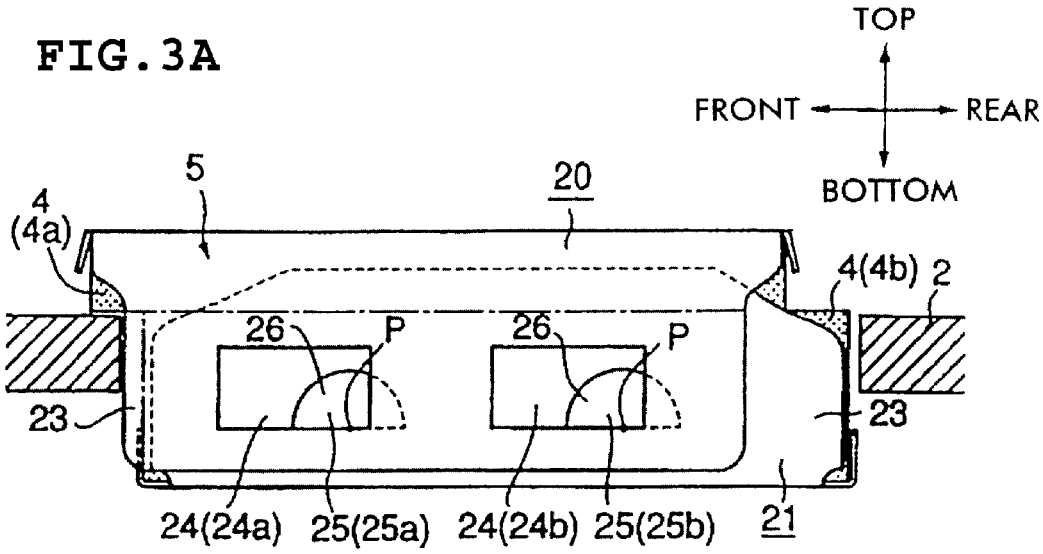
FIGS. 3A, 3B, and 3C are illustrations showing an operation of core-rubbing in the coil apparatus shown in FIG. 1.
Figure 3B:
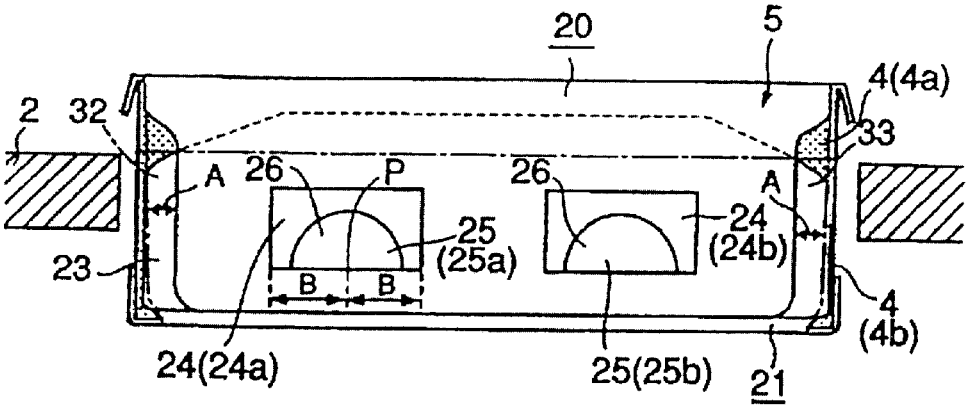
Figure 3C:
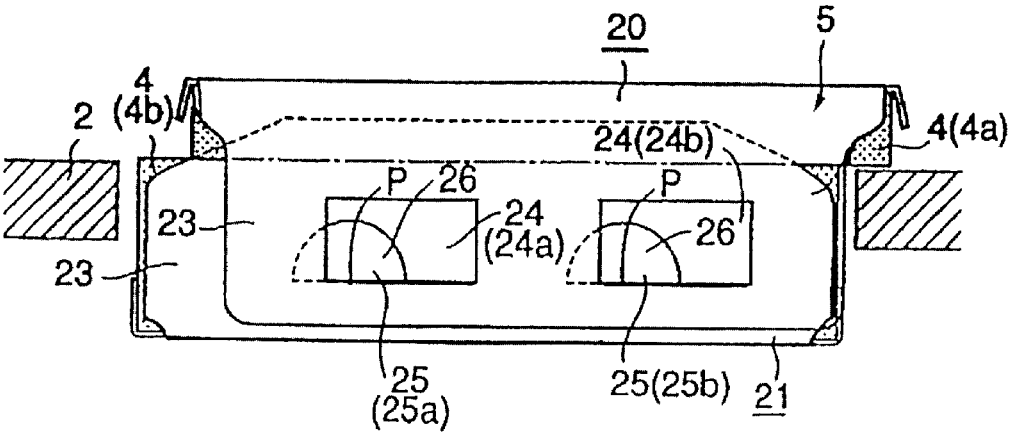

Since the projections 25(25*a*) and 25(25*b*) of the bottom cover 21 have individually the spherical curved faces (or more generally, inclined faces) 26, according to the first embodiment, the top cover 20 can move backward and forward with respect to the bottom cover 21, and the edges of the apertures 24(24*a*) and 24(24*b*) can climb onto the curved faces 26 of the projections 25(25*a*) and 25(25*b*), respectively, as shown in FIGS. 3A and 3C. Therefore, the amount of backward and forward movement of the top cover 20 can be increased.

According to the first embodiment, when the apertures 24(24*a*) and 24(24*b*) are positioned with respect to the projections 25(25*a*) and 25(25*b*), respectively, as shown in FIG. 3B, a distance B from the front edge or the rear edge of the aperture 24(24*a*) or 24(24*b*) to a peak P of the projection 25(25*a*) or 25(25*b*) is set greater than a size A in the backward and forward directions of the cut-away part 32 or 33 shown in FIG. 3B. Therefore, when the top cover 20 moves backward and forward with the edges of the apertures 24(24*a*) and 24(24*b*) climbing onto the curved faces 26 of the projections 25(25*a*) and 25(25*b*), respectively, the top cover 20 stops moving backward and forward with the legs 23(23*a*) and 23(23*b*) of the top cover 20 coming into contact with the front or rear edges of the core-leg-passing through-holes 10(10*a*) and 10(10*c*), respectively, at the respective front sides or rear sides of the legs 23(23*a*) and 23(23*b*) before the edges of the apertures 24(24*a*) and 24(24*b*) climb over the peaks P of the projections 25*a* and 25*b*, respectively, as shown in FIGS. 3A and 3C. Therefore, the edges of the apertures 24(24*a*) and 24(24*b*) do not climb over the peaks P of the projections 25(25*a*) and 25(25*b*), respectively. This prevents the legs 23(23*a*) and 23(23*b*) of the top cover 20 and the bottom cover 21 from being separated from each other, which might occur if the edges of the apertures 24(24*a*) and 24(24*b*) were to climb over the peaks P of the projections 25(25*a*) and 25(25*b*), respectively, and the projections 25(25*a*) and 25(25*b*) were being thereby removed from the apertures 24(24*a*) and 24(24*b*), respectively.

According to the first embodiment, in FIG. 1, the top cover 20 is formed so that a central part 22' of the base plate 22 of the top cover 20 is slightly concave with respect to the left and right ends thereof so that a pressing force can be applied to the core member 4(4*a*) by the base plate 22 at the central part thereof. Since the core members 4(4*a*) and 4(4*b*) are made by sintering a powdered magnetic material, as described above, it is difficult to manufacture the core members 4(4*a*) and 4(4*b*) so as to have highly accurate sizes. With this arrangement, according to the first embodiment, in which the pressing force can be applied to the core member 4(4*a*) by the base plate 22 of the top cover 20 at the central part of the base plate 22, the core members 4(4*a*) and 4(4*b*), which vary in sizes, can be reliably clamped by the top cover 20 and the bottom cover 21.

An assembly process for manufacturing of the coil apparatus 1 is briefly described below. For example, the core members 4(4*a*) and 4(4*b*) are disposed at the top and bottom sides, respectively, of the electronic-part-mounting substrate 2. The core member 4(4*a*) which is an I-type core member is placed on the electronic-part-mounting substrate 2 so as to cover the core-leg-passing through-holes 10(10*a*), 10(10*b*), and 10(10*c*). Core-legs 9(9*a*), 9(9*b*), and 9(9*c*) of the core member 4(4*b*) which is an E-type core member are inserted into the core-leg-passing through-holes 10(10*a*), 10(10*b*), and 10(10*c*), respectively, and the top core member 4(4*a*) and the bottom core member 4(4*b*) are brought into contact with each other.

The top cover 20 and the bottom cover 21 are disposed outside the top core member 4(4*a*) and the bottom core member 4(4*b*), respectively. The legs 23(23*a*) and 23(23*b*) of the top cover 20 and the bottom cover 21 are inserted into the core-leg-passing through-holes 10(10*a*) and 10(10*c*), respectively, so that the top cover 20 and the bottom cover 21 cover the core members 4(4*a*) and 4(4*b*), respectively, and the legs 23(23*a*) and 23(23*b*) of the top cover 20 and the legs 23(23*a*) and 23(23*b*) of the bottom cover 21 are coupled with each other, respectively. In this case, the anchoring faces 27 of the projections 25(25*a*) and 25(25*b*) of the bottom cover 21 anchor upon the edges of the apertures 24(24*a*) and 24(24*b*), respectively, of the top cover 20 so as to prevent removal, whereby the legs 23(23*a*) and 23(23*b*) of the top cover 20 and the bottom cover 21 are maintained in a coupled state.

A pair of the core members 4(4*a*) and 4(4*b*) coupled with each other are clamped by the top cover 20 and the bottom cover 21 which are coupled with each other. The pair of core members 4(4*a*) and 4(4*b*) are mounted on a coil pattern group 3 formed on the electronic-part-mounting substrate 2 in such a manner that the core members 4(4*a*) and 4(4*b*) clamp a part of the coil pattern group 3 therebetween.

By moving the top cover 20 backward and forward with respect to the bottom cover 21 while the top cover 20 and the bottom cover 21 clamp the core members 4(4*a*) and 4(4*b*), the top cover 20 and the core member 4(4*a*) as a unit slidingly move backward and forward with respect to the core member 4(4*b*) which is restricted in backward and forward movement by the bottom cover 21, thereby rubbing the core members 4(4*a*) and 4(4*b*) against each other at the contact part therebetween. By this operation, the respective core members 4(4*a*) and 4(4*b*) are rubbed so as to have mirror-surfaces at the contact part therebetween, and dust received between the core members 4(4*a*) and 4(4*b*) is crushed and removed, whereby the core members 4(4*a*) and 4(4*b*) are brought into close contact with each other.

The coil apparatus 1 according to the first embodiment can be manufactured, as described above.

According to the first embodiment, the core-coupling unit 5 is formed with the top cover 20 and the bottom cover 21. Since the pair of core members 4(4*a*) and 4(4*b*) are coupled with each other by coupling the top cover 20 and the bottom cover 21 with each other, a clamping force applied to the core members 4(4*a*) and 4(4*b*) by the core-coupling unit 5 can be reduced compared with the known coil apparatus.

According to the first embodiment, since the top cover 20 and the bottom cover 21 are provided respectively with the front lips 30 and the rear lips 31, the core members 4(4*a*) and 4(4*b*) can be disposed such that the positions of the core members 4(4*a*) and 4(4*b*) are independently maintained in the backward and forward directions by the top cover 20 and the bottom cover 21, respectively. Since the anti-removal unit, including the apertures 24*a* and 24*b* and the projections 25*a* and 25*b*, which serves to maintain the legs 23*a* and 23*b* of the top cover 20 and the bottom cover 21 in a coupled state, is provided, and the play-gaps S are provided at the front side and the rear side of each projection 25(25*a*) or 25(25*b*) between the projection 25(25*a*) or 25(25*b*) and the respective front and rear side edges of the aperture 24(24*a*) or (24*b*), respectively, the top cover 20 and the bottom cover 21, which clamp the core members 4(4*a*) and 4(4*b*) therebetween, can move backward and forward relative to each other.

With the position-restriction arrangement in which the positions of the core members 4(4*a*) and 4(4*b*) are independently restricted in the backward and forward directions with respect to the top cover 20 and the bottom cover 21, respectively, the anti-removal arrangement in which the top cover 20 and the bottom cover 21 are maintained in a coupled state, and the movement-allowing arrangement in which the top cover 20 and the bottom cover 21 are capable of moving backward and forward relative to each other, the core member 4(4*a*) can move together with the top cover 20 backward and forward with respect to the core member 4(4*b*). The core member 4(4*a*) and the top cover 20 can move backward and forward with a small force and without requiring a large force, whereby the core members 4(4*a*) and 4(4*b*) can be easily rubbed against each other, and the core-rubbing can be performed effectively.

Since it is not necessary to apply a large force to the core members 4(4*a*) and 4(4*b*) when rubbing the same, as described above, breakage of the core members 4(4*a*) and 4(4*b*) is prevented, even when they are made thin, which can occur when applying a large force during core-rubbing. Therefore, the reduction in thickness of the core members 4(4*a*) and 4(4*b*) can be easily advanced, whereby the thinner coil apparatus 1 can be provided.

The core-coupling unit 5 is not provided in the known coil apparatus, whereby the width W in the backward and forward directions of the core-leg-passing through-holes 10(10*a*), 10(10*b*), and 10(10*c*) is set significantly greater than the width w of the core-leg 9(9*a*), 9(9*b*), or 9(9*c*) in order to increase the amount of movement of the core members 4(4*a*) and 4(4*b*) relative to each other. Therefore, variations in position in the backward and forward directions of the core members 4(4*a*) and 4(4*b*) with respect to the coil pattern group 3 and variations in position in the backward and forward directions of the core members 4(4*a*) and 4(4*b*) with respect to each other are likely to occur. When the variations in position occur, the inductance value decreases, thereby deteriorating the characteristics of the coil apparatus 1.

On the other hand, according to the first embodiment, the positions of the core members 4(4*a*) and 4(4*b*) with respect to the top cover 20 and the bottom cover 21, respectively, are restricted in the backward and forward directions by the front lips 30 and the rear lips 31 of the respective top cover 20 and the bottom cover 21. Also, the play-gaps S between each projection 25*a* or 25*b* and the front and rear edges of the aperture 24*a* or 24*b*, respectively, are reduced, whereby the variations in positions of the core members 4(4*a*) and 4(4*b*) with respect to each other can be avoided. Moreover, the width W in the backward and forward directions of each core-leg-passing through-hole 10(10*a*), 10(10*b*), or 10(10*c*) is set substantially the same as the width G in the backward and forward directions of each leg 23(23*a*) and 23(23*b*) of the bottom cover 21, whereby the bottom cover 21 can be fixed by being coupled with the core-leg-passing through holes 10(10*a*) and 10(10*c*), thereby avoiding variations in position of the core members 4(4*a*) and 4(4*b*) with respect to the coil pattern group 3.

According to the first embodiment, since the spherical curved faces 26 are formed on the respective projections 25(25*a*) and 25(25*b*), the edges of apertures 24(24*a*) and 24(24*b*) can individually climb onto the curved faces 26 of the projections 25(25*a*) and 25(25*b*), whereby the amount of backward and forward movement of the top cover 20 can be increased even when reducing the play-gaps S between each projection 25(25*a*) or 25(25*b*) and the front and rear edges of the aperture 24(24*a*) or 24(24*b*), respectively, and core-rubbing can be performed as desired.

With this arrangement in which the respective core members 4(4*a*) and 4(4*b*) can be brought into close contact with each other, and be disposed in positions as designed, deterioration of the characteristics of the coil apparatus 1 can be reliably avoided, whereby the coil apparatus 1 having reliable characteristics can be provided.

Figure 4:
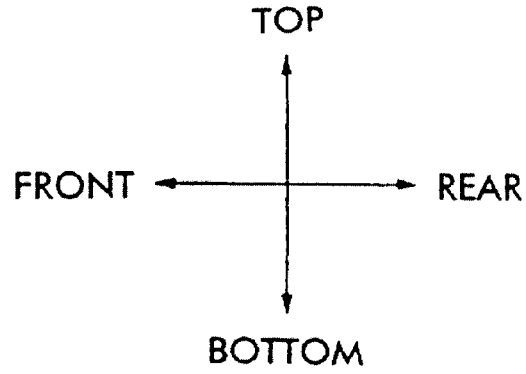
FIG. 4 is an illustration of a coil apparatus according to a second embodiment of the present invention.
Figure 4:
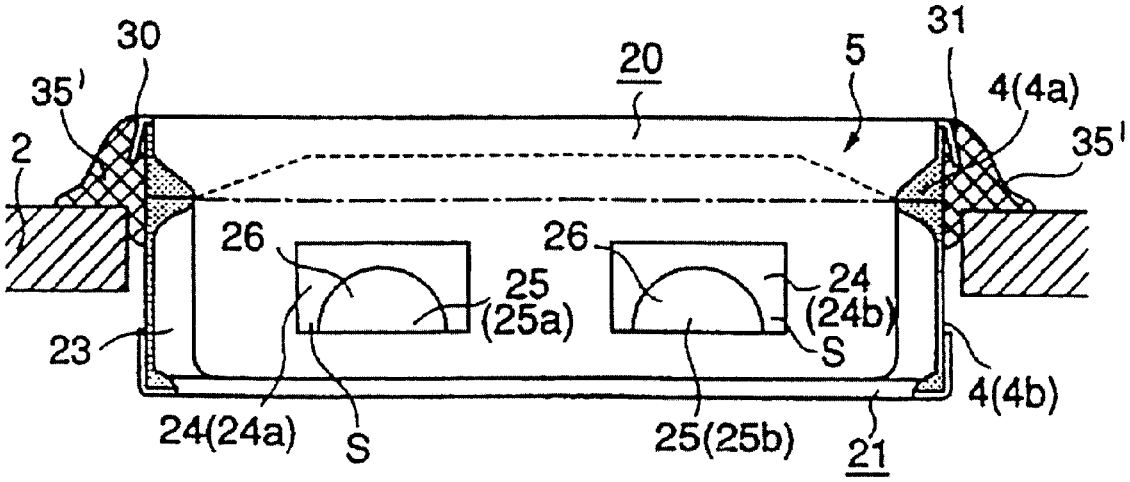

A second embodiment according to the present invention is described below. In FIG. 4, a fixing unit 35' which fixes core members 4(4*a*) and 4(4*b*) is provided, according to the second embodiment. The configuration except for this is the same as that of the coil apparatus 1 according to the first embodiment. Components used in the second embodiment, which correspond to those used in the first embodiment, are referred to by using the same reference numerals, for which description is omitted.

With the arrangement according to the first embodiment, the core members 4(4*a*) and 4(4*b*) of the coil apparatus 1 can be disposed in the positions on the electronic-part-mounting substrate 2 substantially as designed. However, when transporting the electronic-part-mounting substrate 2 on which the coil apparatus 1 is mounted, there is a risk of displacement of the core member 4(4*a*) from the designed position due to, for example, the play-gaps S between the projections 25*a* and 25*b* and the edges of the apertures 24*a* and 25*b*, respectively. Although the displacement is small, the core-fixing unit 35' is provided to fix the core members **4(4*a*) and 4(4*b*) to the electronic-part-mounting substrate 2, according to the second embodiment, in order to further improve reliability of the characteristics of the coil apparatus 1**.

According to the second embodiment, the core members **4(4*a*) and 4(4*b*), which have been rubbed against each other in the same fashion as described in the first embodiment, are disposed in the designed positions, and are fixed to the electronic-part-mounting substrate 2 at the front and rear side-faces of the respective core members 4(4*a*) and 4(4*b*) by using the core-fixing unit 35'. The core-fixing unit 35' may be a bonding material including a resin such as a silicone or an epoxy, as shown in FIG. 4. Front and rear lips 30 and 31 of a top cover 20 are also fixed to the electronic-part-mounting substrate 2 by bonding, whereby the core members 4(4*a*) and 4(4*b*) are more firmly fixed to the electronic-part-mounting substrate 2 because the top cover 20 is fixed to the electronic-part-mounting substrate 2** by bonding.

Since a bottom cover 21 and the core member **4(4*b*) are substantially fixed to the electronic-part-mounting substrate 2 in the same fashion as in the first embodiment, the core members 4(4*a*) and 4(4*b*) can be fixed to the electronic-part-mounting substrate 2 in the designed positions only by fixing the core member 4(4*a*) and the top cover 20 to the electronic-part-mounting substrate 2 by using the core-fixing unit 35'** which in this example is a bonding material.

According to the second embodiment, the core member **4(4*a*), after being rubbed, is fixed to the electronic-part-mounting substrate 2 by bonding by using the core-fixing unit 35', whereby the displacement of the core member 4(4*a*) is reliably avoided when transporting the electronic-part-mounting substrate 2 which has been mounted with the coil apparatus 1. With this arrangement, the reliability of the characteristics of the coil apparatus 1** can be further improved.

The present invention is not limited to the first and second embodiments described above, and it may be embodied in various other ways. For example, although according to the first and second embodiments, the legs **23(23*a*) and 23(23*b*) of the top cover 20 are each provided with the two apertures 24(24*a*) and 24(24*b*), one, three, or more than three apertures may be provided in each leg 23(23*a*) or 23(23*b*). The number of the projections 25(25*a*) and 25(25*b*) formed in the respective legs 23(23*a*) and 23(23*b*) is not limited to two for each leg 23(23*a*) or 23(23*b*). However, a plurality of the apertures 24(24*a*) and 24(24*b*) and the projections 25(25*a*) and 25(25*b*) are preferably formed in the respective legs 23(23*a*) and 23(23*b*) for maintaining the legs 23(23*a*) and 23(23*b*) of the top cover 20 and the bottom cover 21** in a stably coupled state.

Although in the above-described embodiments, the projections **25(25*a*) and 25(25*b*) are individually provided with the spherical curved-faces 26 which are inclined faces onto which the edges of the apertures 24(24*a*) and 24(24*b*) climb when the top cover 20 moves backward and forward, the shape of each inclined face is not limited to the spherical curved-face. Each of the projections 25(25*a*) and 25(25*b*)** may have the shape of, for example, a triangular pyramid, and the inclined face may be formed of a triangular face of the triangular pyramid.

Although according to the above-described embodiments, the top cover 20 and the bottom cover 21 couple with each other so that the legs **23(23*a*) and 23(23*b*) of the top cover 20 are disposed outside the legs 23(23*a*) and 23(23*b*), respectively, of the bottom cover 21, the top cover 20 and the bottom cover 21 may inversely couple with each other so that the legs 23(23*a*) and 23(23*b*) of the bottom cover 21 are disposed outside the legs 23(23*a*) and 23(23*b*), respectively, of the top cover 20. In this case, the apertures 24(24*a*) and 24(24*b*) are formed in the legs 23(23*a*) and 23(23*b*), respectively, of the bottom cover 21, which are disposed outside, and the projections 25(25*a*) and 25(25*b*) are formed on the legs 23(23*a*) and 23(23*b*), respectively, of the top cover 20**, which are disposed inside.

According to the above embodiments, the bottom cover 21 is fixed, and the top cover 20 moves backward and forward with respect to the bottom cover 21. On the contrary, the top cover 20 may be fixed, and the bottom cover 21 may move backward and forward with respect to the top cover 20. In this case, the cut-away parts 32 and 33 are provided in the respective legs **23(23*a*) and 23(23*b*) of the bottom cover 21** which moves. An E-type core member is disposed on the top side which is the fixed side, and an I-type core member is disposed on the bottom side which is the moving side.

Although according to the embodiments described above, the cut-away parts 32 and 33 are formed in the top cover 20, the cut-away parts 32 and 33 are not necessarily provided when the width W in the backward and forward directions of each core-leg-passing through-hole **10*a*, 10*b*, or 10*c* is greater than the width G in the backward and forward directions of each leg 23*a* or 23*b* of the bottom cover 21. In this case, since the bottom cover 21 is not fixed by the core-leg-passing through-holes 10(10*a*), 10(10*b*), and 10(10*c*), another suitable fixing arrangement for fixing the bottom cover 21 is provided for core-rubbing. The top cover 20 and the bottom cover 21 may be independently moved backward and forward for core-rubbing. In these cases, core-fixing arrangements that fix both core members 4(4*a*) and 4(4*b*) are provided instead of the core-fixing unit 35' according to the second embodiment which fixes only the core member 4(4*a*)**.

Figure 5C:
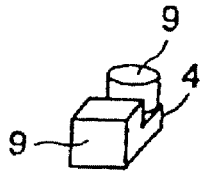
Figure 5D:
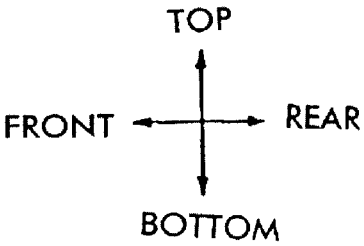
Figure 5D:
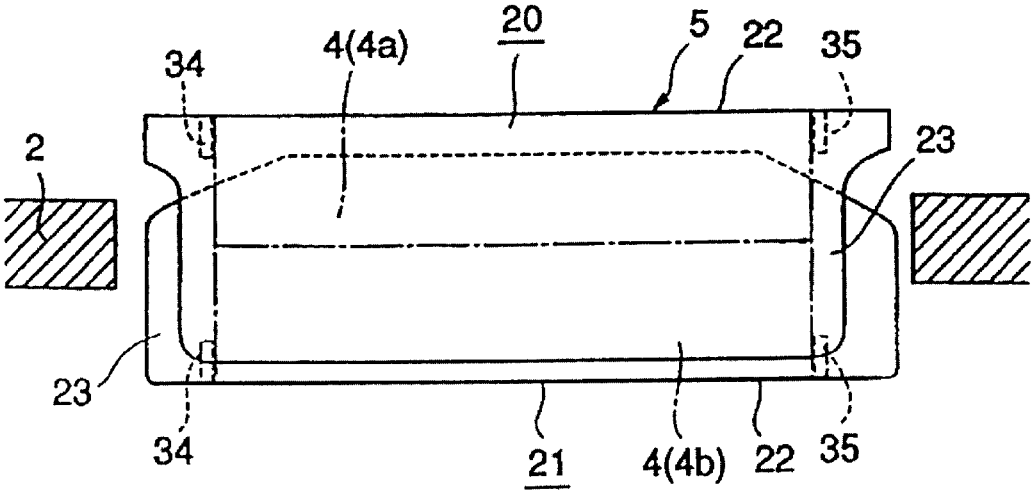

Although according to the above embodiments, an E-type core member is used as the bottom core member **4(4*b*), an EER-type core member 4*b* shown in FIG. 5B in which the intermediate leg 9*b* has a circular section may be used as the core member 4(4*b*). A UR-type core member 4 shown in FIG. 5C, which has a U-shaped cross-section and has a rectangular-pole-shaped core-leg 9 and a cylindrical core-leg 9, may be also used as the core member 4(4*b*). When mounting the UR-type core member 4 on the coil pattern group 3, one of the two core-legs 9 is disposed at a central part of the coil pattern group 3 formed on the electronic-part-mounting substrate 2, and the other core-leg 9 is disposed outside the coil pattern group 3**.

According to the first and second embodiments, an I-type core member is used as the top core member **4(4*a*) and an E-type core member is used as the bottom core member 4(4*b*). However, the E-type core members, the EER-type core members, or the UR-type core members may be respectively disposed at either or both of the top and bottom sides. In this case, the top cover 20 and the bottom cover 21 are individually formed extending backward and forward from the core members 4(4*a*) and 4(4*b*), respectively, and are independently provided with lips 34 and 35 at the inner faces of the base plates 22 of the top cover 20 and the bottom cover 21, the lips 34 and 35 maintaining the positions in the backward and forward directions of the core members 4(4*a*) and 4(4*b*)**.

Figure 6A:
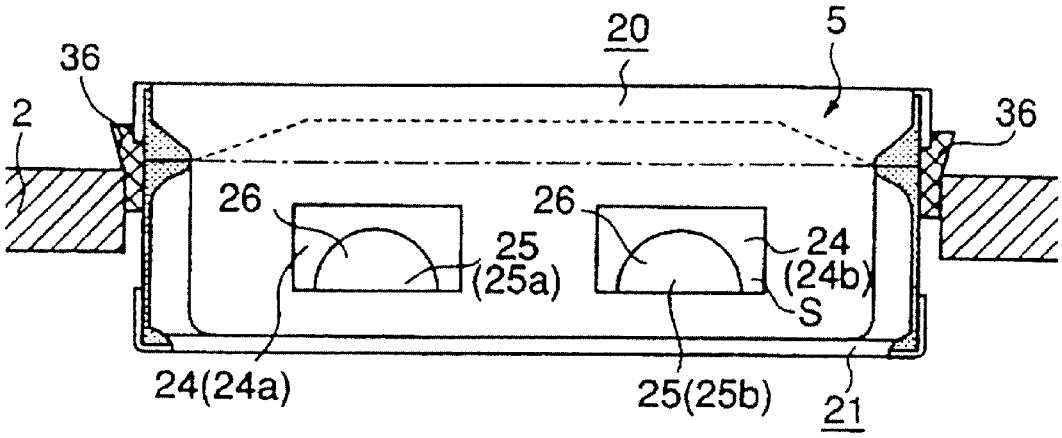
FIGS. 6A, 6B, and 6C are illustrations of fixing members for fixing the core members, according to other embodiments.

Although according to the second embodiment, the core member **4(4*a*) is fixed to the electronic-part-mounting substrate 2 by bonding by using the core-fixing unit 35', the core members 4(4***a*) and 4(4*b*) may be fixed to the electronic-part-mounting substrate 2 by using fixing unit 36, as shown in FIG. 6A. The fixing unit 36 shown in FIG. 6A includes wedge-shaped parts, and is made of, for example, a urethane, a synthetic rubber, or the like. The fixing unit 36 is inserted in small gaps between the core members 4(4*a*) and 4(4*b*) and the electronic-part-mounting substrates 2, as shown in FIG. 6A, thereby applying a pressing force to the core members 4(4*a*) and 4(4*b*) and fixing the core members 4(4*a*) and 4(4*b*) to the electronic-part-mounting substrate 2.

Figure 6B:
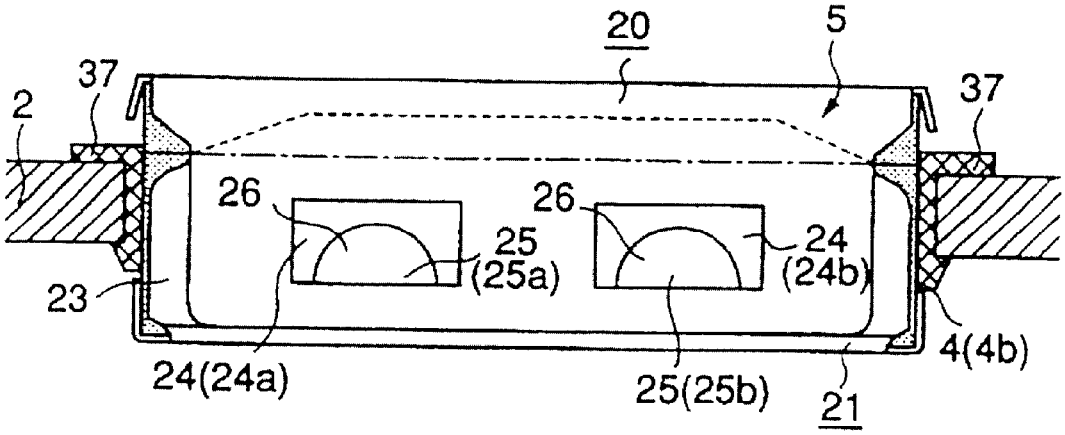
Figure 6C:
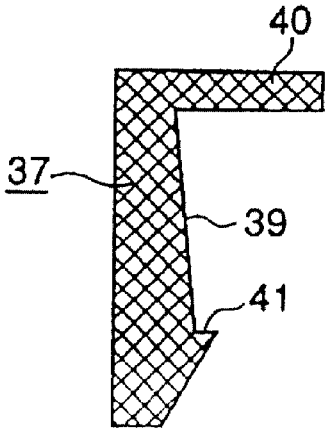

A fixing unit 37 may be provided, as shown in FIG. 6B. FIG. 6C shows the fixing unit 37. The fixing unit 37 is made of, for example, a urethane, a synthetic rubber, or the like, and includes fixing parts, each having a main body 39, an anchoring part 40, and an anti-removal hook 41. The fixing unit 37 is inserted into the gaps between the core members 4(4*a*) and 4(4*b*) and the electronic-part-mounting substrate 2 at the main body 39 of the fixing unit 37, the main body 39 applying a pressing force to the core members 4(4*a*) and 4(4*b*), thereby fixing the core members 4(4*a*) and 4(4*b*) to the electronic-part-mounting substrate 2. The anchoring parts 40 and the anti-removal hooks 41 of the fixing unit 37 serve to reliably prevent the fixing unit 37 from removal.

Although according to the second embodiment, the core members 4(4*a*) and 4(4*b*) are fixed to the electronic-part-mounting substrate 2 at both the front and rear sides of the core members 4(4*a*) and 4(4*b*), the core members 4(4*a*) and 4(4*b*) may be fixed to the electronic-part-mounting substrate 2 at only one of the front side and the rear side of the core members 4(4*a*) and 4(4*b*). However, the core members 4(4*a*) and 4(4*b*) are fixed to the electronic-part-mounting substrate 2 preferably at a plurality of positions of the core members 4(4*a*) and 4(4*b*) so as to fix the same in a stable manner.

Although according to the second embodiment, the core member 4(4*a*) is fixed directly to the electronic-part-substrate 2 by using the core-fixing unit 35', the core members 4(4*a*) and 4(4*b*) may be indirectly fixed to the electronic-part-mounting substrate 2, for example, in a manner such that the fixing unit 36 or 37 shown in FIG. 6A or 6B, respectively, is disposed in the gaps between the legs 23(23*a*) and 23(23*b*) of the top cover 20 and the electronic-part-mounting substrate 2, and the core-coupling unit 5 is applied to at least one of the left side and the right side of the core members 4(4*a*) and 4(4*b*).

Although the present invention has been described in relation to particular embodiments thereof, many other variations and modifications and other uses will become apparent to those skilled in the art. Therefore, the present invention is not limited by the specific disclosure herein.

What is claimed is:

1. A coil apparatus comprising:

a coil pattern group formed on an electronic-part-mounting substrate for mounting electronic parts;

a pair of core members mounted on the coil pattern group in such a manner that the pair of core members clamp a part of the coil pattern group from the top and bottom sides of the electronic-part-mounting substrate;

core-leg-passing through-holes formed in a region of the electronic-part-mounting substrate in which the coil pattern group is provided, the core-leg-passing through-holes being provided for receiving core-legs passing therethrough, the core-legs being provided on at least one of the pair of core members; and a core-coupling unit which clamps and couples the pair of core members with each other from the top and bottom sides of the electronic-part-mounting and passes through the core-leg-passing through-holes, wherein the core-coupling unit includes a top cover and a bottom cover each having a U-shape, the top cover and the bottom cover clamping the core members at the top and bottom sides of the core members between base plates of the respective U-shaped top cover and bottom cover with legs of the respective U-shaped top cover and bottom cover being coupled with each other, the top cover and the bottom cover comprising:

an anti-removal unit which maintains the legs of the respective top cover and bottom cover in a coupled state;

a backward-forward-core-position-restricting unit which restricts the positions of the core members with respect to the respective top cover and bottom cover in the backward and forward directions; and a backward-forward-movement-allowing unit which allows backward and forward movement of the top cover and the bottom cover relative to each other when the core members are clamped between the top cover and the bottom cover, the legs of which are maintained in a coupled state by the anti-removal unit, and which allows moving of the top core member and the top cover as a unit or the bottom core member and the bottom cover as another unit backward and forward relative to each other, the positions of the top core member and the bottom core member being independently restricted in the backward and forward directions with respect to the top cover and the bottom cover, respectively, by the backward-forward-core-position-restricting unit.

2. A coil apparatus according to claim 1, wherein the anti-removal unit comprises apertures formed in first legs of one of the top cover and the bottom cover, the first legs being disposed outside second legs of the other one of the top cover and the bottom cover, and projections formed on the second legs of said other one of the top cover and the bottom cover, for anchoring at the corresponding apertures so as to prevent removal, the second legs being disposed inside the first legs of said one of the top cover and the bottom cover, and the backward-forward-movement-allowing unit is formed with play-gaps between each projection and respective front and rear edges of the aperture of the anti-removal unit.

3. A coil apparatus according to claim 2, wherein the backward-forward-core-position-restricting unit includes lips which protrude from front ends and rear ends, respectively, of the base plates in the thickness direction thereof-and which anchor at front end-faces and rear end-faces, respectively, of the core members.

4. A coil apparatus according to claim 3, further comprising:

a fixing unit which fixes the core members either directly, or indirectly via the core-coupling unit, to the electronic-part-mounting substrate.

5. A coil apparatus according to claim 2, further comprising:

a fixing unit which fixes the core members either directly, or indirectly via the core-coupling unit, to the electronic-part-mounting substrate.

6. A coil apparatus according to claim 2, wherein the legs of at least one of the top cover and the bottom cover are each provided with cut-away parts for providing relief at regions of the leg which come into contact with edges of the core-leg-passing through-hole when said one of the top cover and the bottom cover moves backward and forward, and the projections of the anti-removal unit each include inclined faces along which the edges of each aperture can climb when the top cover and the bottom cover move backward and forward relative to each other.

7. A coil apparatus according to claim 6, wherein the backward-forward-core-position-restricting unit includes lips which protrude from front ends and rear ends, respectively, of the base plates in the thickness direction thereof and which anchor at front end-faces and rear end-faces, respectively, of the core members.

8. A coil apparatus according to claim 7, further comprising:

a fixing unit which fixes the core members either directly, or indirectly via the core-coupling unit, to the electronic-part-mounting substrate.

9. A coil apparatus according to claim 6, further comprising:

a fixing unit which fixes the core members either directly, or indirectly via the core-coupling unit, to the electronic-part-mounting substrate.

10. A coil apparatus according to claim 1, wherein the backward-forward-core-position-restricting unit includes lips which protrude from front ends and rear ends, respectively, of the base plates in the thickness direction thereof and which anchor at front end-faces and rear end-faces, respectively, of the core members.

11. A coil apparatus according to claim 10, further comprising:

a fixing unit which fixes the core members either directly, or indirectly via the core-coupling unit, to the electronic-part-mounting substrate.

12. A coil apparatus according to claim 1, further comprising:

a fixing unit which fixes the core members either directly, or indirectly via the core-coupling unit, to the electronic-part-mounting substrate.

13. A coil apparatus according to one of claims 4, 5, 8, 9, 11 or 12, wherein the fixing unit comprises a bonding material made of a resin.

14. A method for manufacturing a coil apparatus which comprises a coil pattern group formed on an electronic-part-mounting substrate for mounting electronic parts; a pair of core members mounted on the coil pattern group in such a manner that the pair of core members clamp a part of the coil pattern group from the top and bottom sides of the electronic-part-mounting substrate; core-leg-passing through-holes formed in a region of the electronic-part-mounting substrate in which the coil pattern group is provided, the core-leg-passing through-holes being provided for receiving core-legs passing therethrough, the core-legs being provided on at least one of the pair of core members; and a core-coupling unit for clamping and coupling the pair of core members with each other from the top and bottom sides of the electronic-part-mounting substrate by using the core-leg-passing through-holes, wherein the core-coupling unit includes a top cover and a bottom cover each having a U-shape, the top cover and the bottom cover clamping the core members at the top and bottom sides of the core members between base plates of the respective U-shaped top cover and bottom cover with legs of the respective U-shaped top cover and bottom cover being coupled with each other, the top cover and the bottom cover comprising an anti-removal unit which maintains the legs of the respective top cover and bottom cover in a coupled state; a backward-forward-core-position-restricting unit which restricts the positions of the core members with respect to the respective top cover and bottom cover in the backward and forward directions; and a backward-forward-movement-allowing unit which allows backward and forward movement of the top cover and the bottom cover relative to each other when the core members are clamped between the top cover and the bottom cover, the legs of which are maintained in a coupled state by the anti-removal unit, and which allows moving of the top core member and the top cover as a unit or the bottom core member and the bottom cover as another unit backward and forward relative to each other, the positions of the top core member and the bottom core member being independently restricted in the backward and forward directions with respect to the top cover and the bottom cover, respectively, by the backward-forward-core-position-restricting unit, the method comprising the steps of:

disposing the pair of core members at the top and bottom sides, respectively, of the electronic-part-mounting substrate;

disposing the top cover of the core-coupling unit outside the top core member and the bottom cover of the core-coupling unit outside the bottom core member;

mounting the pair of core members onto the coil pattern group, the pair of core members being coupled with each other by being clamped by the top cover and the bottom cover which are coupled with each other; and rubbing the top core member and the bottom core member against each other at a contact part therebetween by slidingly moving at least one of the core members and the corresponding cover as a unit relative to the other core member and corresponding cover, thereby bringing the top core member and the bottom core member into closer contact with each other.

15. A method for manufacturing a coil apparatus, according to claim 14, further comprising the step of:

fixing the core members either directly, or indirectly via the core-coupling unit, to the electronic-part-mounting substrate after the step of rubbing the top core member and the bottom core member against each other.

16. A method for manufacturing a coil apparatus, according to claim 15, wherein said fixing step is carried out by use of a bonding material made of a resin.

* * * * *